US005377359A

United States Patent [19]

Jiang

[11] Patent Number: 5,377,359

[45] Date of Patent: Jan. 3, 1995

[54] FOOD SPILL CATCHING DEVICE

[75] Inventor: Curtis T. Jiang, San Francisco, Calif.

[73] Assignee: QLH USA, Inc., San Francisco, Calif.

[21] Appl. No.: 164,965

[22] Filed: Dec. 10, 1993

[51] Int. Cl.[6] ..... A41D 13/04; A45F 5/00

[52] U.S. Cl. ..... 2/48; 2/46; 2/51

[58] Field of Search ..... 2/46, 48, 49.1, 49.2, 2/49.3, 49.4, 49.5, 50, 51; 24/7; 248/229, 291, 444.1, 460; 224/194, 247

[56] References Cited

U.S. PATENT DOCUMENTS

| | | | |
|---|---|---|---|
| D. 338,319 | 8/1993 | Bickel | D2/229 |
| 851,107 | 4/1907 | Rink | 2/52 X |
| 1,108,557 | 8/1914 | Dudley | 2/49.3 X |
| 1,261,362 | 4/1918 | Cook | 248/444.1 |
| 2,265,690 | 12/1941 | Fiedler | 2/48 X |
| 4,114,199 | 9/1978 | Malan | 2/49.2 |
| 4,660,224 | 4/1987 | Ashcraft | 2/48 |
| 4,865,286 | 9/1989 | Clayburn | 248/460 |
| 4,887,315 | 12/1989 | Bezdek | 2/49 A |
| 5,062,558 | 11/1991 | Stang | 224/270 |
| 5,075,897 | 12/1991 | Daniels | 2/49.4 X |
| 5,285,940 | 2/1994 | Goulter | 2/49.2 X |

*Primary Examiner*—Jeanette E. Chapman

[57] ABSTRACT

This invention pertains to a food spill catching device comprising a first device body coupled to a second device body by pivotal means. The two device bodies are frictionally movable relative to each other into, and out of, closed position facing each other. The second device body may be held on a table while the first device body is adapted to serve as a shield for protecting a user's clothing from being soiled by food spills while dining at a table.

1 Claim, 1 Drawing Sheet

FOOD SPILL CATCHING DEVICE

BACKGROUND OF THE INVENTION

1. Field of Invention

This invention relates to a food spill catching device adapted to be held on a table for protecting a user's clothing from being soiled by food spills while dining.

2. Description of Prior Art

The best prior art known to Applicant include U.S. Pat. Nos. D338,319 to Bickel; 851,107 to Rink; 4,114,199 to Malan; 4,660,224 to Ashcraft; 4,887,315 to Bezdek; and, 5,062,558 to Stang. However, none of prior art devices are designed to operate without being mounted on a user, to have a clipping means to secure a napkin, to be washable and reusable, and to provide an alternate use as a trivet for a hot food dish.

SUMMARY OF THE INVENTION

The present invention provides a food spill catching device;

which provides a shield to catch food spills of a user;

which is workable without being mounted on the user;

which is washable and reusable;

which comprises a clipping means to secure a piece of paper, a napkin or the like; and Which, may also serve as a trivet for a hot food dish.

Still other features and advantages of the present invention will become apparent in view of the following description of the drawings and appended claims.

DETAILED DESCRIPTION OF THE PREFERRED EMBODIMENT

Figure 1:
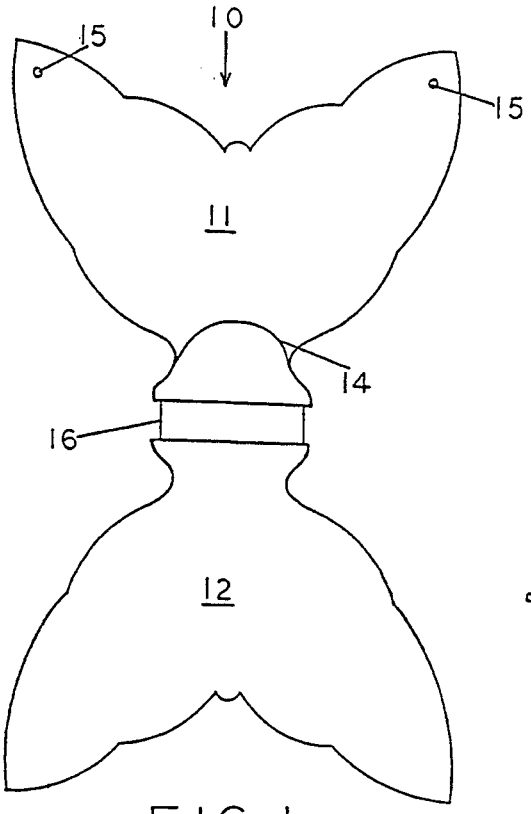
FIG. 1 is a top plan view of a food spill catching device of the present invention.

Referring to the drawings, a substantially planar food spill catching device 10, made of rigid metal sheet material is shown in extended or unfolded positions.

Figure 2:
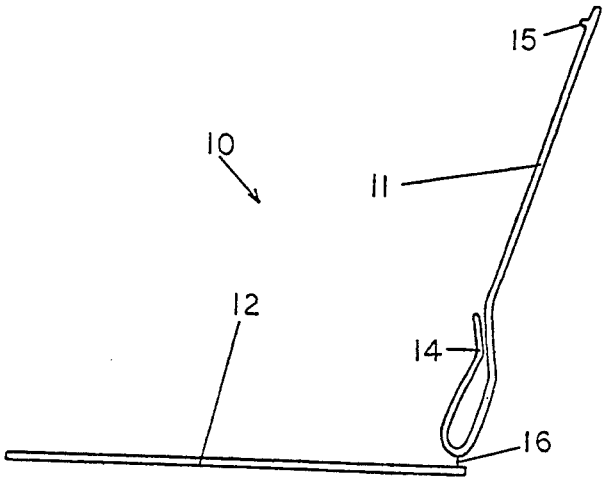
FIG. 2 is a side elevation view, not in scale, of FIG. 1 in a substantially unfolded position, and having one upper device body defining a food catching position.

Device 10 comprises a pair of butterfly-like upper body 11 and lower body 12 coupled to each other by means of pivotal means 16, shown in symbolic form, which provides friction movements enabling the two bodies to be spread apart and held in a substantially unfolded position (FIG. 2) whereas body 11 defines a food spill catching position and is used as a shield to protect a user's clothing from being soiled by catching food spills while dining.

Figure 3:
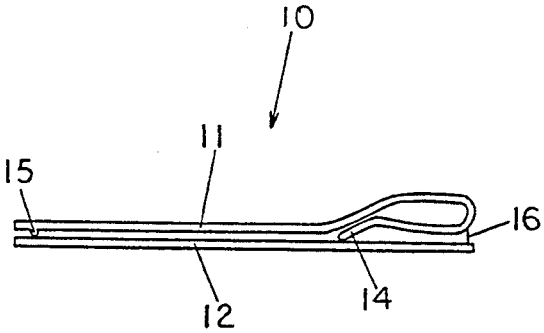
FIG. 3 is another side elevation view of FIG. 1 in a completely folded position being used as a trivet.

On the side facing body 12, body 11 comprises a pair of knobs 15 at its upper end, and is bent upon itself at its lower end to form a clipping means 14 for securing one end of a napkin, not shown, thereby enabling the other end of the napkin to be hung over and wrapped around the upper end of body 11 to form a shielding structure with a size slightly larger than that of body 11. Thanks to Knobs 15, Bodies 11 and 12 are spaced apart a small distance such that their folded or closed position may serve as a trivet (FIG. 3).

It to be understood that the invention is not limited to the embodiment described above. For example, the sizes, shapes and thickness the food spill catching device and the clipping means can vary. Other embodiments are within the spirit and the scope of the invention, and fall within the scope of the claims.

What is claimed is:

1. A food spill catching device comprising:

a. a lower planar body and an upper substantially planar body, on one side facing the lower body, the upper body having a pair of knobs at one upper end thereof, and being bent upon itself at one lower end thereof to form a clip;

b. pivoting means pivotally securing the upper body to the lower body;

c. trivet means formed from a folded position of the upper and lower bodies when the upper body pivots toward the lower body;

wherein the upper body is adapted to be used as a shield for protecting a user's clothing from being soiled by catching food spills of the user, wherein the knobs are used to space the upper body from the lower body a small distance such that their folded position serves as a trivet and wherein the clip is adapted to secure a sheet material to form a shielding structure with a size slightly larger than that of the upper body.

* * * * *